US007479736B2

(12) United States Patent
Shinohe et al.

(10) Patent No.: US 7,479,736 B2
(45) Date of Patent: Jan. 20, 2009

(54) DISPLAY DEVICE WITH VARYING PHOSPHOR STRUCTURE

(75) Inventors: Koji Shinohe, Kawasaki (JP); Manabu Ishimoto, Kawasaki (JP); Kenji Awamoto, Kawasaki (JP); Hitoshi Yamada, Kawasaki (JP); Akira Tokai, Kawasaki (JP); Yosuke Yamazaki, Kawasaki (JP); Hitoshi Hirakawa, Kawasaki (JP)

(73) Assignee: Shinoda Plasma Corporation, Hyogo (JP)

( * ) Notice: Subject to any disclaimer, the term of this patent is extended or adjusted under 35 U.S.C. 154(b) by 601 days.

(21) Appl. No.: 11/052,774

(22) Filed: Feb. 9, 2005

(65) Prior Publication Data

US 2006/0038476 A1 Feb. 23, 2006

(30) Foreign Application Priority Data

Aug. 20, 2004 (JP) ..... 2004-240915

(51) Int. Cl.
*H01J 17/49* (2006.01)

(52) U.S. Cl. ..... 313/582; 313/282

(58) Field of Classification Search ..... 313/582–587, 313/609, 292

See application file for complete search history.

(56) References Cited

U.S. PATENT DOCUMENTS 5,825,128 A * 10/1998 Betsui et al. ..... 313/582
6,577,061 B2 * 6/2003 Sano et al. ..... 313/582
6,611,099 B1 * 8/2003 Murata et al. ..... 313/582
6,633,117 B2 * 10/2003 Shinoda et al. ..... 313/484
6,642,653 B1 11/2003 Hirano et al.
6,650,055 B2 * 11/2003 Ishimoto et al. ..... 313/623
6,838,825 B2 * 1/2005 Shiiki et al. ..... 313/582
6,853,125 B1 * 2/2005 Irie et al. ..... 313/489
7,247,989 B1 * 7/2007 Wedding ..... 313/587

(Continued)

FOREIGN PATENT DOCUMENTS

CN 1344003 4/2002

(Continued)

OTHER PUBLICATIONS

European Office Action dated Mar. 17, 2008 for corresponding European Patent Application No. 05250699.5-2208.

(Continued)

*Primary Examiner*—Toan Ton
*Assistant Examiner*—Kevin Quarterman
(74) *Attorney, Agent, or Firm*—Staas & Halsey LLP

(57) ABSTRACT

A display device capable of realizing a desired color temperature is provided. Phosphor layers 5*a*, 5*b* and 5*c*, which are excited by ultraviolet radiation produced by discharge and emit red, green and blue visible light, are formed inside a red, green and blue gas discharge tube 1*a*, 1*b*, and 1*c*, respectively. The height Yc of the phosphor layer 5*c* with respect to a rear support body 20 is higher than the heights Ya and Yb of the phosphor layers 5*a* and 5*b* with respect to the rear support member 20, and establishes the relationship Yc>Ya=Yb. Therefore, the distance from the phosphor layer 5*c* to the opposite discharge surface on a front support body is shorter than those from the phosphor layers 5*a* and 5*b*, the visible light emitted from the display device 10 is shifted toward blue, that is, the color temperature increases.

20 Claims, 12 Drawing Sheets

U.S. PATENT DOCUMENTS

| | | | | |
|---|---|---|---|---|
| 2002/0063532 | A1 | 5/2002 | Chen et al. | |
| 2002/0079843 | A1 | 6/2002 | Hirao et al. | |
| 2002/0195936 | A1* | 12/2002 | Kato et al. | 313/582 |
| 2003/0048068 | A1 | 3/2003 | Yamada et al. | |
| 2003/0052592 | A1 | 3/2003 | Shinoda et al. | |
| 2003/0090443 | A1* | 5/2003 | Kobayashi | 345/60 |
| 2005/0088090 | A1 | 4/2005 | Wu et al. | |
| 2005/0088091 | A1* | 4/2005 | Tokai et al. | 313/582 |
| 2006/0082301 | A1* | 4/2006 | Okafuji et al. | 313/582 |

FOREIGN PATENT DOCUMENTS

| | | |
|---|---|---|
| CN | 1404090 | 3/2003 |
| EP | 11176337 | 7/1999 |
| EP | 11327498 | 11/1999 |
| JP | 2003-092085 | 3/2003 |
| JP | 2003-272562 | 9/2003 |

OTHER PUBLICATIONS

Chinese Office Action dated Aug. 15, 2008.

* cited by examiner

DISPLAY DEVICE WITH VARYING PHOSPHOR STRUCTURE

CROSS-REFERENCE TO RELATED APPLICATIONS

This non-provisional application claims priority under 35 U.S.C. §119(a) on patent application Ser. No. 2004-240915 filed in Japan on Aug. 20, 2004, the entire contents of which are hereby incorporated by reference.

BACKGROUND OF THE INVENTION

The present invention relates to a display device capable of displaying images (video images) such as moving images by arranging a large number of thin gas discharge tubes with a discharge gas sealed therein.

Plasma displays (PDP) are practically used as thin, large-screen next generation displays. In a PDP, discharge is caused in a very small closed space, and ultraviolet radiation (wavelength: 147 nm) emitted by the discharge excites a phosphor layer and is converted into visible light. A large display device using this light-emitting principle of PDP is proposed, which is capable of displaying video images such as moving images by arranging a large number of gas discharge tubes, each of which is produced by providing a phosphor layer inside a thin glass tube with an external diameter of 1 mmϕ and a thickness of 0.1 mm, for example, and sealing a discharge gas therein (see, for example, Japanese Patent Application Laid Open No. 2003-92085). Since this display device is a self emission type display device, it is possible to display bright video images and realize a large screen more than 100 inches without increasing the manufacturing facilities, manufacturing processes and cost. Thus, this display device is suitable for applications where the entire surface of an indoor wall is made a display device.

FIG. 10 is a schematic perspective view showing one example of a conventional display device using gas discharge tubes. FIG. 11 is a plan view showing essential sections, and FIG. 12 is a structural cross sectional view along the XII-XII line of FIG. 10. Note that a part of components are not illustrated in FIG. 11 to facilitate understanding. A conventional display device 80 comprises a large number of red gas discharge tubes 90*a*, green gas discharge tubes 90*b*, and blue gas discharge tubes 90*c* arranged in a direction orthogonal to the axial direction thereof, and a rear support body (substrate) 96 and a front support body (substrate) 98 sandwiching the respective gas discharge tubes between them. On the gas discharge tube-side surface of the rear support body 96, address electrodes (also called selection electrodes) 97, 97, . . . are disposed along the axial direction of the gas discharge tubes 90, while on the gas discharge tube-side surface of the front support body 98, sustain electrodes (display electrodes) 99, 99, . . . (each of which is composed of a pair of 99*a* and 99*b*) are disposed at predetermined intervals in a direction crossing the address electrodes 97 on the same level.

Each of the gas discharge tubes 90*a*, 90*b* and 90*c* is made of a thin transparent insulating tubular body, for example, a translucent glass tube 91 in the form of a cylinder with an internal diameter of 0.8 mm and a thickness of 0.1 mm. Formed on the inner surface of each glass tube 91 is a secondary electron emitting film (protective film) 92 for decreasing a voltage (discharge voltage) necessary for causing discharge. A phosphor support member 93 with an axial cross section in the shape of a crescent is disposed inside the glass tube 91, and a phosphor layer 94, which is to be excited by ultraviolet radiation produced by discharge to emit light, is formed on the inner surface of the phosphor support member 93. The phosphor layer 94 is made of a phosphor that emits light of a predetermined color for each gas discharge tube 90*a*, 90*b*, 90*c*. Moreover, a discharge gas 95 such as Xe—Ne and Xe—He is sealed in the glass tube 91.

First, by using either of the sustain electrodes 99*a* and 99*b* as a scanning electrode and applying a voltage between the scanning electrode and the address electrode 97, address discharge (counter discharge) for writing display data is selectively caused, and wall charge is produced on the inner wall of glass corresponding to the discharge cell. Subsequently, a voltage is applied between a pair of sustain electrodes 99*a* and 99*b* to cause display discharge (surface discharge) for retaining the display in the cell in which wall charge is produced by the address discharge. With this discharge, collision with Xe in the discharge gas occurs, and ultraviolet radiation is emitted. The ultraviolet radiation excites the phosphor layer 94, and is converted into visible light and emitted outside. Therefore, as shown in the plan view showing essential sections of FIG. 11, a region partitioned by the intersecting address electrodes 97 and the sustain electrodes 99*a*, 99*b* makes a unit light emission region (cell), and the resolution is determined based on the pitch V of a pair of sustain electrodes 99 and the pitch H of the addles electrodes 97.

By the way, in a display device as described above, a blue phosphor has lower excitation efficiency compared to a green phosphor and a red phosphor, and consequently there is a problem that the blue phosphor has insufficient luminance and causes a low color temperature. Hence, a display device was proposed to realize a desired color temperature by adjusting the color temperature by varying the width of the phosphor support member, depending on each emission color (see, for example, Japanese Paten Application Laid Open No. 2003-272562).

BRIEF SUMMARY OF THE INVENTION

The present invention has been made with the aim of solving the above problems, and it is an object of the present invention to provide a display device capable of realizing a desired color temperature by adjusting the distance to the discharge region (discharge electrode pair) for each emission color of the phosphor layers by varying the height of the phosphor layer with respect to the rear support body of gas discharge tubes, depending on each emission color, wherein the phosphor layer is formed on a part of the inner surface of the gas discharge tube.

Another object of the invention is to provide a display device capable of realizing a desired color temperature by adjusting the excitation efficiency for each emission color of the phosphor layers by varying the thicknesses of the phosphor layers depending on each emission color.

Still another object of the invention is to provide a display device capable of realizing a desired color temperature by adjusting the amount of discharge current for each emission color by varying the shapes of respective electrodes for discharging a discharge gas on the gas discharge tubes including the phosphor layers, depending on each emission color of the phosphor layers.

A display device according to a first aspect of the invention comprises: a plurality of gas discharge tubes having a discharge gas sealed therein, and phosphor layers corresponding to a plurality of emission colors on inner surfaces thereof; a pair of support bodies for holding the plurality of gas discharge tubes therebetween; and a plurality of pairs of electrodes disposed on a surface of one of the support bodies and extending in a direction crossing an axial direction of the tubes, wherein the gas discharge tubes discharge by applying a voltage to the pairs of electrodes, whereby the phosphor layers emit light, and this display device is characterized in that each of the phosphor layers is formed on a part of the inner surface of the gas discharge tube, and a distance from an end of the phosphor layer on the one support body side to the other support body varies depending on each emission color of the phosphor layers.

According to the first aspect of the invention, the phosphor layer is formed inside the gas discharge tube so that the distance (height) between one support body that makes a pair with the other support body on which a plurality of pairs of electrodes extending in a direction crossing the axial direction of the gas discharge tubes are disposed and an end of the phosphor layer on said other support body side varies depending on each emission color. The luminescence intensity and color characteristic of the phosphor layer are determined by the phosphor material used. Therefore, by changing the height of the phosphor layer with respect to the other support body based on the phosphor material used, it is possible to adjust the distance to the discharge region for each emission color and allow the display device to have a desired color temperature (value). More specifically, by increasing the height of the phosphor layer, it is possible to shorten the distance between the facing phosphor layer and one support body that is the discharge region, prevent self-absorption of ultraviolet radiation and increase the utilization efficiency, and it is also possible to increase the amount of phosphor receiving the ultraviolet radiation and consequently increase the luminescence intensity.

A display device according to a second aspect of the invention is a display device comprising: a plurality of gas discharge tubes having a discharge gas sealed therein, and phosphor layers corresponding to a plurality of emission colors on inner surfaces thereof; a pair of support bodies for holding the plurality of gas discharge tubes therebetween; and a pair of electrodes extending in a direction crossing an axial direction of the tubes on a surface of one of the support bodies, wherein the discharge gas is discharged by applying a voltage to the pairs of electrodes, and the phosphor layers emit light, and this display device is characterized in that thicknesses of the phosphor layers vary depending on each emission color of the phosphor layers.

According to the second aspect of the invention, the phosphor layers whose thickness varies depending on each emission color of the phosphor layers are formed inside the gas discharge tubes. The luminescence intensity and color characteristic of the phosphor layer are determined by the phosphor material used. Therefore, by changing the thickness of the phosphor layer based on the phosphor material used, it is possible to adjust the excitation efficiency for each emission color and allow the display device to have a desired color temperature (value). More specifically, by increasing the thickness of the phosphor layer, it is possible to prevent self-absorption of ultraviolet radiation and increase the utilization efficiency, and it is also possible to increase the ultraviolet reflectance of the phosphor and consequently increase the luminescence intensity.

A display device according to a third aspect of the invention is based on the first or second aspect of the invention, and characterized in that the gas discharge tubes have substantially the same internal diameter.

According to the third aspect of the invention, since the internal diameters of the gas discharge tubes are substantially the same irrespective of the emission colors of the phosphor layers, the area of the light emitting surface does not vary depending on each emission color, and therefore it is possible to make voltage characteristics necessary for causing discharge substantially the same and prevent the operating margin for driving the display device from being narrowed.

A display device according to a fourth aspect of the invention is based on any one of the first through third aspects of the invention, and characterized in that the phosphor layer is formed on a phosphor support member, and a shape of the phosphor support member is specified for each emission color of the phosphor layer to be formed, whereby the phosphor layers have different shapes.

According to the fourth aspect of the invention, the height of the phosphor layer from the base of the phosphor support member or the thickness of the phosphor layer is adjusted by varying the shape of the phosphor support member depending on each emission color of the phosphor layer to be formed. Since the shape of the phosphor support member can be easily formed by a known redraw molding method, the height of the phosphor layer from the base of the phosphor support member or the thickness of the phosphor layer can be adjusted extremely easily. Since the height of the phosphor layer from the base of the phosphor support member has the same relationship as the height of the phosphor layer with respect to the other support body, it is possible to adjust the height of the phosphor layer with respect to the other support body.

A display device according to a fifth aspect of the invention is based on the fourth aspect of the invention, and characterized in that the phosphor support member has a depression whose depth varies depending on each emission color of the phosphor layer to be formed.

According to the fifth aspect of the invention, the phosphor layer is formed on the phosphor support member with a depression whose depth varies depending on each emission color. The luminescence intensity and color characteristic of the phosphor layer are determined by the phosphor material used. Therefore, by changing the depression depth of the phosphor support member based on the phosphor material used, it is possible to adjust the height of the phosphor layer from the base of the phosphor support member, that is, the height of the phosphor layer with respect to the rear support body, or the thickness of the phosphor layer, and realize a display device with a desired color temperature.

A display device according to a sixth aspect of the invention is based on any one of the first through fifth aspects of the invention, and characterized in that the shapes of the plurality of pairs of electrodes on the gas discharge tubes including the phosphor layers vary depending on each emission color of the phosphor layers.

According to the sixth aspect of the invention, it is possible to adjust the amount of discharge current for each emission color of the phosphor layers by disposing the electrodes having different shapes on the tubular bodies including the phosphor layers, depending on each emission color of the phosphor layers. Therefore, since the luminescence intensity can be adjusted extremely easily for each emission color, it is possible to realize a display device with a desired color temperature.

A producing method for a display device according to a seventh aspect of the invention, the display device comprises: phosphor layer support members having depressions; and phosphor layers formed on the depressions of the phosphor layer support members, in a plurality of gas discharge tubes having a discharge gas sealed therein, wherein the gas discharge tubes discharge through the discharge gas by applying a voltage to the pairs of electrodes, provided outside of the gas discharge tubes, whereby the phosphor layers emit light, the producing method comprising the steps of: filling the depressions of the phosphor support members with phosphor pastes; removing the phosphor pastes which exceed a capacity of the depressions of the respective phosphor support members; baking remaining phosphor pastes in the depressions of the phosphor support members to form the phosphor layers; and inserting the phosphor support members having phosphor layer thereon into the gas discharge tube.

According to the seventh aspect of the invention, the depressions of the phosphor support members are filled with phosphor pastes, respectively, so that the depressions of the phosphor support members are covered completely. Sliding movement of a squeegee or the like serves to keep phosphor pastes equivalent to each capacity of the depressions remaining on the depressions of the phosphor support members. Then, the remaining pastes in the depressions of the phosphor layer support members are baked to form the phosphor layers on the depressions. Consequently, the phosphor pastes, quantity of which is determined by each capacity of depressions, are formed on the phosphor layer support members, thus a variation in capacity of the phosphor layers of each gas discharge tube is alleviated, resulting in that a display device having less variation in emission luminance of each gas discharge tube is achieved. Compared with conventional printing methods, the process of the invention realizes high throughput at a low cost. It is advisable to slide the squeegee in an axial direction of the phosphor support members, i.e., in a longitudinal direction of the depressions of the phosphor support members so as to cause a rotational motion on the phosphor pastes, thereby facilitating flowage of the phosphor pastes in a longitudinal direction of the depressions of the phosphor support members.

As described above, according to the present invention, in the case where the phosphor layer is formed on a part of the inner surface of the gas discharge tube, the height of the phosphor layer with respect to the rear support body of the gas discharge tubes is varied depending on each emission color, and therefore it is possible to adjust the distance to the discharge region (discharge electrode pair) for each emission color of the phosphor layers and allow the display device to have a desired color temperature. Moreover, according to the present invention, by forming the phosphor layers whose thickness varies depending on each emission color, it is possible to adjust the excitation efficiency for each emission color of the phosphor layers and allow the display device to have a desired color temperature. Furthermore, according to the present invention, by changing the shapes of the electrodes for discharging the discharge gas so that their shapes on the gas discharge tubes including the phosphor layers vary depending on each emission color of the phosphor layers, it is possible to adjust the amount of discharge current for each emission color of the phosphor layers and allow the display device to have a desired color temperature.

The above and further objects and features of the invention will more fully be apparent from the following detailed description with accompanying drawings.

DETAILED DESCRIPTION OF THE INVENTION

As described above, when the width of the phosphor support member is varied depending on each emission color, since the area of the emission surface varies depending on each emission color and the voltage characteristic necessary for causing discharge varies depending on each emission color, there is a driving problem that the operating margin for driving the display device is narrow.

Moreover, in a conventional display device, sustain electrodes of the same shape are disposed for all emission colors and power is supplied. Therefore, the adjustment range for the amount of discharge current for each emission color is insufficient, and it is difficult to realize a desired color temperature.

The present invention has been made with the aim of solving the above problems, and it is an object of the present invention to provide a display device capable of realizing a desired color temperature by varying the height of the phosphor layer with respect to the rear support body of gas discharge tubes, depending on each emission color, and adjusting the distance to a discharge region (discharge electrode pair) for each emission color of the phosphor layer, wherein the phosphor layer is formed on a part of the inner surface of the gas discharge tube.

It is another object of the present invention to provide a display device capable of adjusting the excitation efficiency for each emission color of phosphor layers and realizing a desired color temperature by forming the phosphor layers whose thickness varies depending on each emission color. The present invention is embodied by the following embodiments.

EMBODIMENT 1

Figure 1:
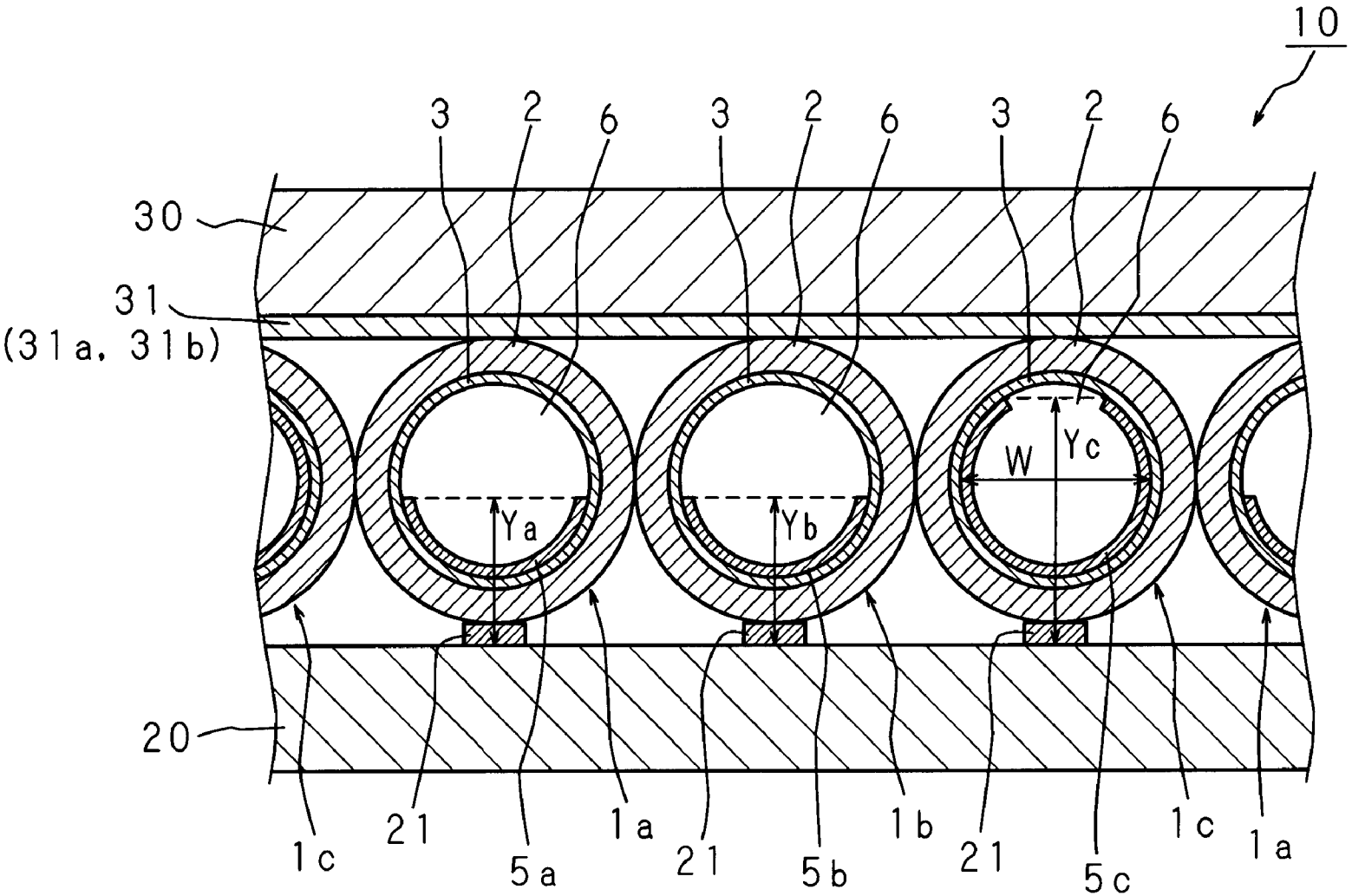
FIG. 1 is a structural cross sectional view showing one example of display device according to Embodiment 1 of the present invention.

FIG. 1 is a structural cross sectional view showing one example of display device according to Embodiment 1 of the present invention. A display device 10 according to Embodiment 1 comprises a large number of red gas discharge tubes 1*a*, green gas discharge tubes 1*b*, and blue gas discharge tubes 1*c* (which may hereinafter be referred to as gas discharge tubes 1 if there is no need to distinguish them from each other), which are regularly arranged in a direction orthogonal to the axial direction thereof and sandwiched between a rear support body (substrate) 20 and a front support body (substrate) 30.

As the rear support body 20 and front support body 30, glass substrates are illustrated, but the rear support boy 20 and front support body 30 may also be made of flexible sheets such as polycarbonate films and PET (polyethylene terephthalate) films having light transmitting properties. In this case, it may be possible to deform the flexible sheets along the outer shape of gas discharge tubes 1.

On the gas discharge tube-side surface of the rear support body 20, address electrodes 21, 21, . . . are disposed along the axial direction of the gas discharge tubes 1, while on the gas discharge tube-side of the front support body 30, sustain electrodes 31, 31, . . . (each of which is composed of a pair of 31*a* and 31*b*) are disposed at predetermined intervals in a direction crossing the address electrodes 21 on the same level.

Each gas discharge tube 1 is made of a thin transparent insulating tubular body, for example, a translucent glass tube 2 in the form of a cylinder with an internal diameter of 0.8 mm and a thickness of 0.1 mm. On the inner surface of the glass tube 2, a secondary electron emitting film (also called a protective film) 3 is formed for decreasing a voltage (discharge voltage) necessary for causing discharge.

Phosphor layers 5*a*, 5*b* and 5*c*, which are excited by ultraviolet radiation produced by discharge and emit red, green and blue visible lights, are formed in the red gas discharge tube 1*a*, green gas discharge tube 1*b*, and blue gas discharge tubes 1*c*, respectively. As the phosphor layers 5*a*, 5*b* and 5*c*, it is possible to use, for example, (Y, Gd)$BO_3$:Eu, $Zn_2SiO_4$:Mn, $BaMgAl_{10}O_{17}$:Eu.

Moreover, a discharge gas 6 such as Xe—Ne and Xe—He is sealed in the glass tubes 1. The reason for this is to stabilize the discharge by mixing a Ne or He gas with a Xe gas which has a longest resonance line wavelength (mainly 147 nm) and highest strength among noble gases.

In such a display device 10, either of the sustain electrodes 31*a* and 31*b* is used as a scanning electrode, and a voltage is applied between the scanning electrode and the address electrode 21 to selectively cause address discharge (counter discharge) for writing display data and produce wall charge on the inner wall of glass corresponding to the discharge cell. Subsequently, a voltage is applied between a pair of sustain electrodes 31*a* and 31*b* to cause display discharge (surface discharge) for retaining the display in the cell in which the wall charge is produced by the address discharge. With this discharge, collision with Xe in the discharge gas occurs, and ultraviolet radiation is emitted. The ultraviolet radiation is converted into red, green and blue visible lights by the phosphor layers 5*a*, 5*b* and 5*c*, respectively, and emitted outside.

The height Yc of the blue phosphor layer 5*c* with respect to the rear support body 20 is higher than heights Ya and Yb of the red and green phosphor layers 5*a*, 5*b* with respect to the rear support body 20, and establishes the relationship Yc>Ya=Yb. Further, since glass tubes of the same shape are used as the red gas discharge tube 1*a*, green gas discharge tube 1*b* and blue gas discharge tube 1*c*, their internal diameters are substantially the same. In other words, the widths (indicated as "W") of the phosphor layers 5*a*, 5*b* and 5*c*, which are the intervals in a radial direction of the respective red gas discharge tube 1*a*, green gas discharge tube 1*c* and blue gas discharge tube 1*c*, are substantially the same irrespective of the emission colors of the phosphor layers. Therefore, although the discharge voltage (voltage applied to the sustain electrodes) of the respective discharge tubes 1*a*, 1*b*, 1*c* is substantially the same as the conventional example, the distance between the facing discharge surface (sustain electrode 31) and blue phosphor layer 5*c* with a greater height with respect to the rear support body 20 is shorter than the distances between the facing discharge surface and red and green phosphor layers 5*a* and 5*b*, and the area irradiated with ultraviolet radiation becomes larger. Consequently, the luminescence intensity of the blue phosphor layer 5*c* relatively increases, and the visible light emitted from the display device 10 is shifted toward blue, that is, the color temperature increases.

Figure 2:
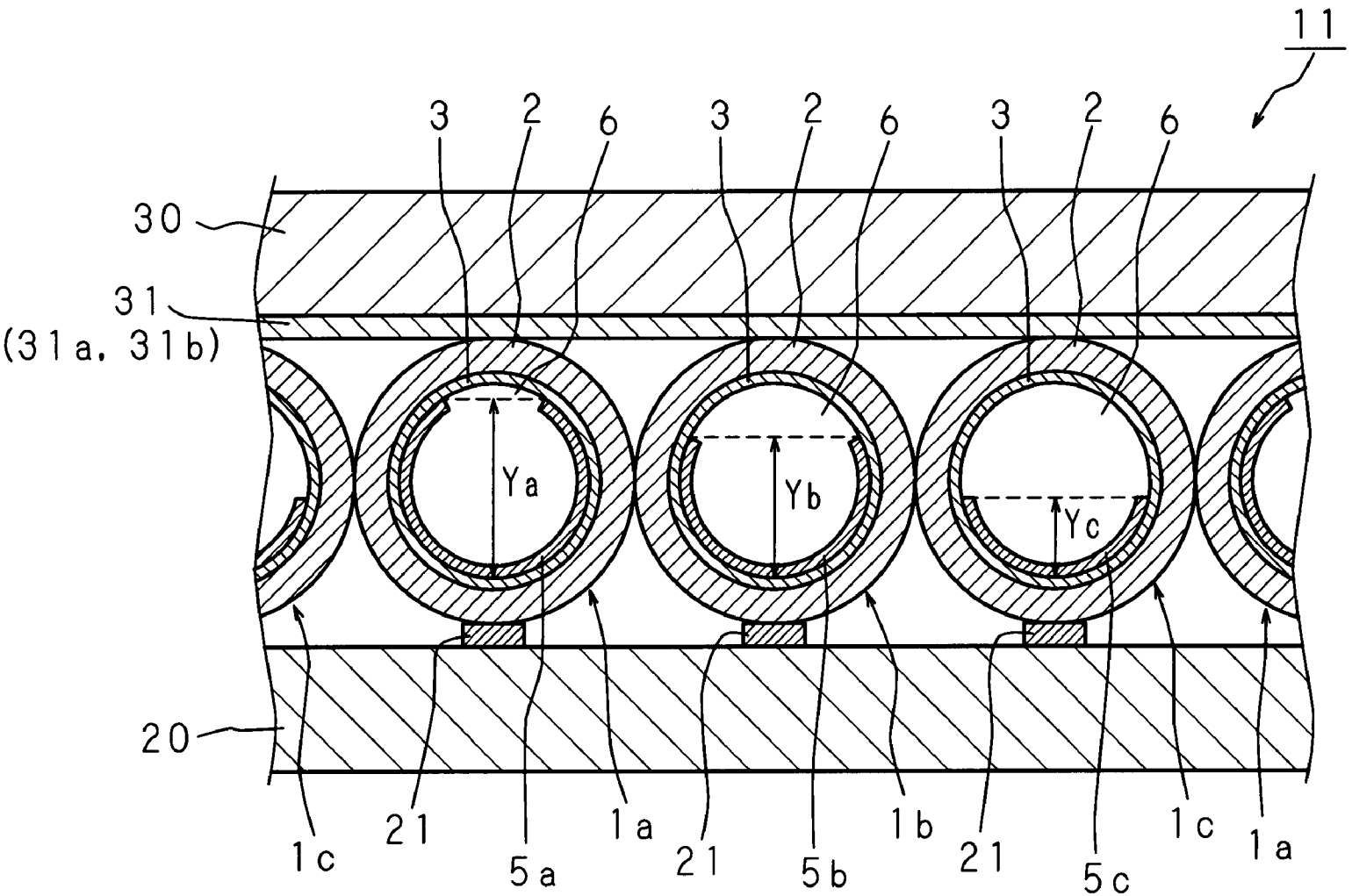
FIG. 2 is a structural cross sectional view showing another example of display device according to Embodiment 1 of the present invention.

Note that the set values for the heights Ya, Yb and Yc of the phosphor layers 5*a*, 5*b* and 5*c* are not limited to those satisfying the relationship Yc>Ya=Yb, and it is possible to obtain a desired color temperature by suitably setting the heights Ya, Yb and Yc, based on the luminescence intensities and color characteristics of the phosphors used. For example, in order to intentionally decrease the color temperature, as shown in FIG. 2, the height Ya of the red phosphor layer 5*a* may be made higher than the heights Yb and Yc of the other phosphor layers 5*b* and 5*c*. FIG. 2 illustrates a display device 11 satisfying Ya>Yb>Yc.

In short, Embodiment 1 focuses on a characteristic of the gas discharge tube that the luminescence intensity is increased by bringing the phosphor layer closer to the discharge surface, and illustrates one example in which the color temperature is easily adjusted by adjusting the luminescence intensity for each emission color by suitably setting the heights of the phosphor layers.

EMBODIMENT 2

Figure 3:
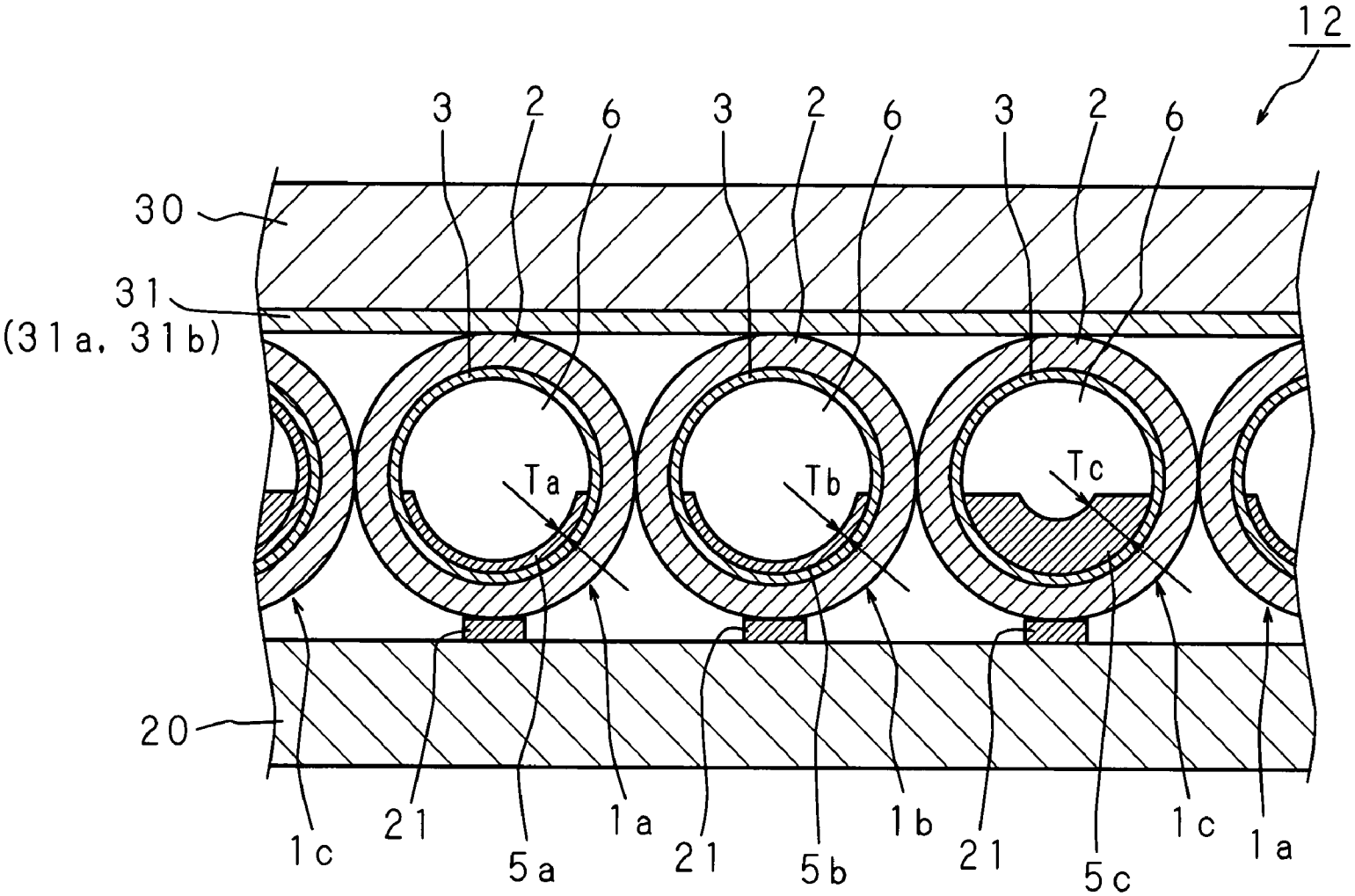
FIG. 3 is a structural cross sectional view showing one example of display device according to Embodiment 2 of the present invention.

FIG. 3 is a structural cross sectional view showing one example of display device according to Embodiment 2 of the present invention. In a display device 12 according to Embodiment 2 of the present invention, the thickness Tc of the blue phosphor layer 5*c* is thicker than the thicknesses Ta and Tb of the red and green phosphor layers 5*a*, 5*b*, and establishes the relationship Tc>Ta=Tb. The widths of the phosphor layers 5*a*, 5*b* and 5*c*, which are the intervals in a radial direction of the respective red gas discharge tube 1*a*, green gas discharge tube 1*c* and blue gas discharge tube 1*c*, are substantially the same irrespective of the emission colors of the phosphor layers. Since other structures are the same as those in Embodiment 1, the corresponding parts are designated with the same codes, and the detailed explanation thereof is omitted.

Thus, by varying the thicknesses of the phosphor layers, the ultraviolet reflectance is increased. Consequently, the luminescence intensity of the blue phosphor layer 5*c* relatively increases, and the visible light emitted from the display device 12 is shifted toward blue, that is, the color temperature increases.

Figure 4:
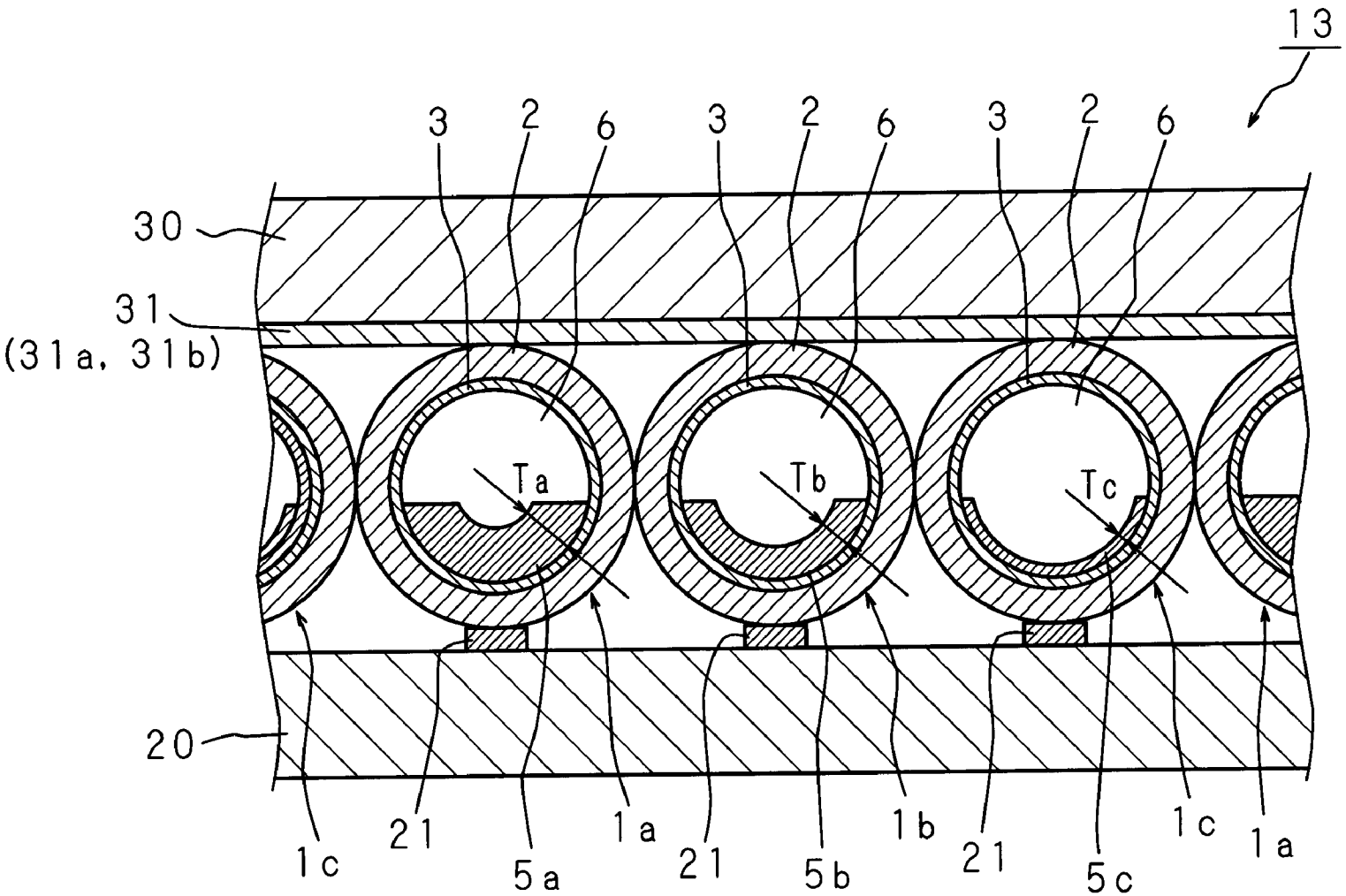
FIG. 4 is a structural cross sectional view showing another example of display device according to Embodiment 2 of the present invention.

Note that the set values for the thicknesses Ta, Tb and Tc of the phosphor layers 5*a*, 5*b* and 5*c* are not limited to those satisfying the relationship Tc>Ta=Tb, and it is possible to obtain a desired color temperature by suitably setting the thicknesses Ta, Tb and Tc, based on the luminescence intensities and color characteristics of the phosphors used. For example, in order to intentionally decrease the color temperature, as shown in FIG. 4, the thickness Ta of the red phosphor layer 5*a* may be made thicker than the thicknesses Tb and Tc of the other phosphor layers 5*b* and 5*c*. FIG. 4 illustrates a display device 13 satisfying Ta>Tb>Tc.

In short, Embodiment 2 focuses on a characteristic of the gas discharge tube that the luminescence intensity becomes higher with an increase in the thickness of the phosphor layer, and illustrates one example in which the color temperature is easily adjusted by adjusting the luminescence intensity for each emission color by suitably setting the thicknesses of the phosphor layers.

EMBODIMENT 3

Figure 5:
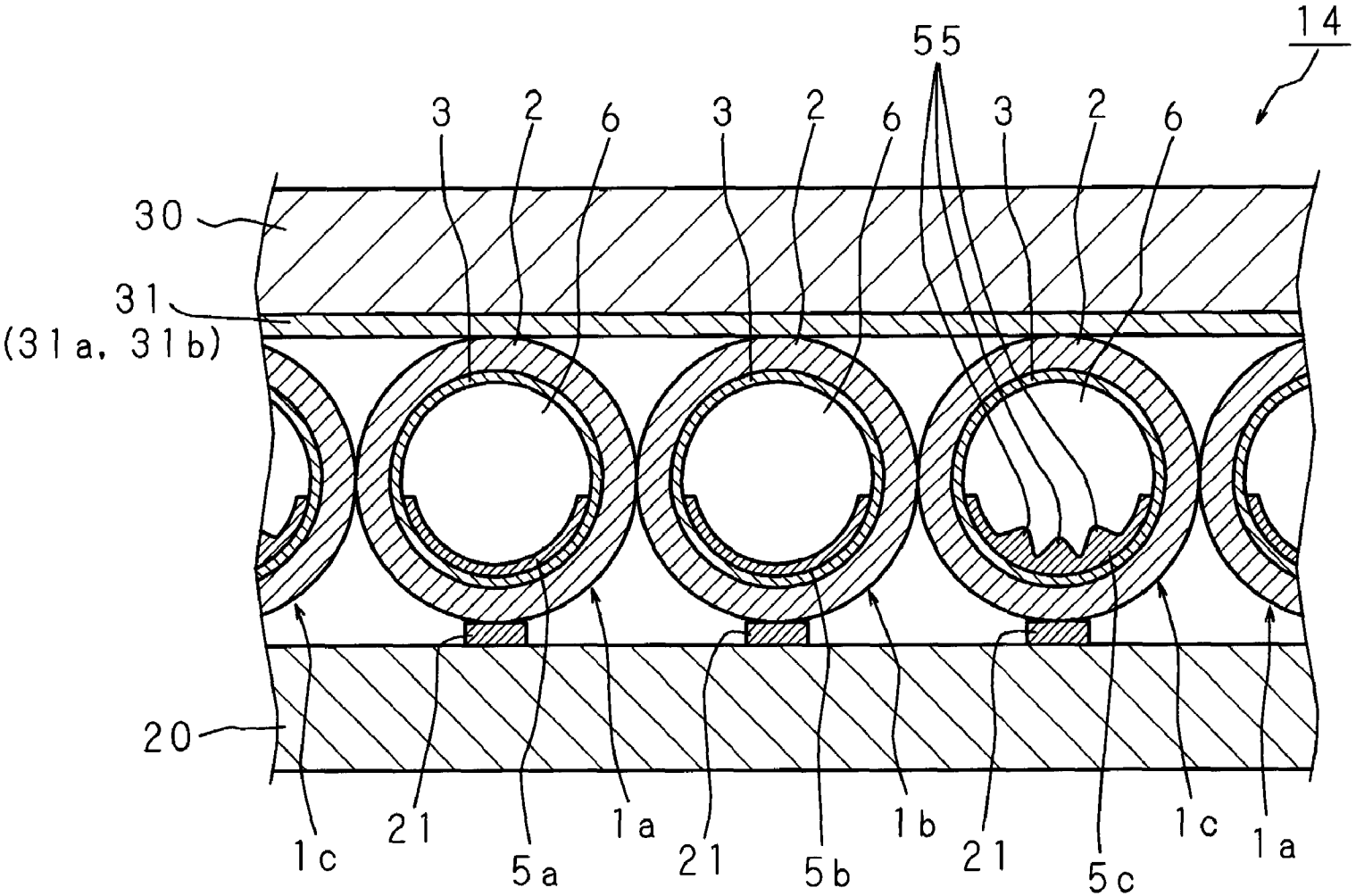
FIG. 5 is a structural cross sectional view showing one example of display device according to Embodiment 3 of the present invention.

FIG. 5 is a structural cross sectional view showing one example of display device according to Embodiment 3 of the present invention. In a display device 14 according to Embodiment 3 of the present invention, each of the red and green phosphor layers 5*a* and 5*b* has an axial cross section in the shape of a crescent moon. On the other hand, the axial cross section of the blue phosphor layer 5*c* has a shape composed of a plurality of projections and depressions arranged alternately like saw teeth. The widths of the phosphor layers 5*a*, 5*b* and 5*c* are substantially the same irrespective of the emission colors of the phosphor layers. Since other structures are the same as those in Embodiment 1, the corresponding parts are designated with the same codes, and the detailed explanation thereof is omitted.

Thus, the projecting sections 55 of the blue phosphor layer 5*c* are closer to the front support body 30, and the area irradiated with ultraviolet radiation becomes larger due to the presence of depressions and projections. Consequently, the luminescence intensity of the blue phosphor layer 5*c* relatively increases compared to the red and green phosphor layers 5*a* and 5*b*, and the visible light emitted from the display device 14 is shifted toward blue, that is, the color temperature increases. Note that the shapes of the phosphor layers 5*a*, 5*b* and 5*c* are not limited to the illustrated shapes, and it is possible to obtain a desired color temperature by suitably setting the shapes of the respective phosphor layers, based on the luminescence intensities and color characteristics of the phosphors used.

EMBODIMENT 4

Although Embodiment 1 illustrates the phosphor layers directly formed in the gas discharge tubes, it may also be possible to insert a known phosphor support member, where a phosphor layer is formed, into the gas discharge tube.

Figure 6:
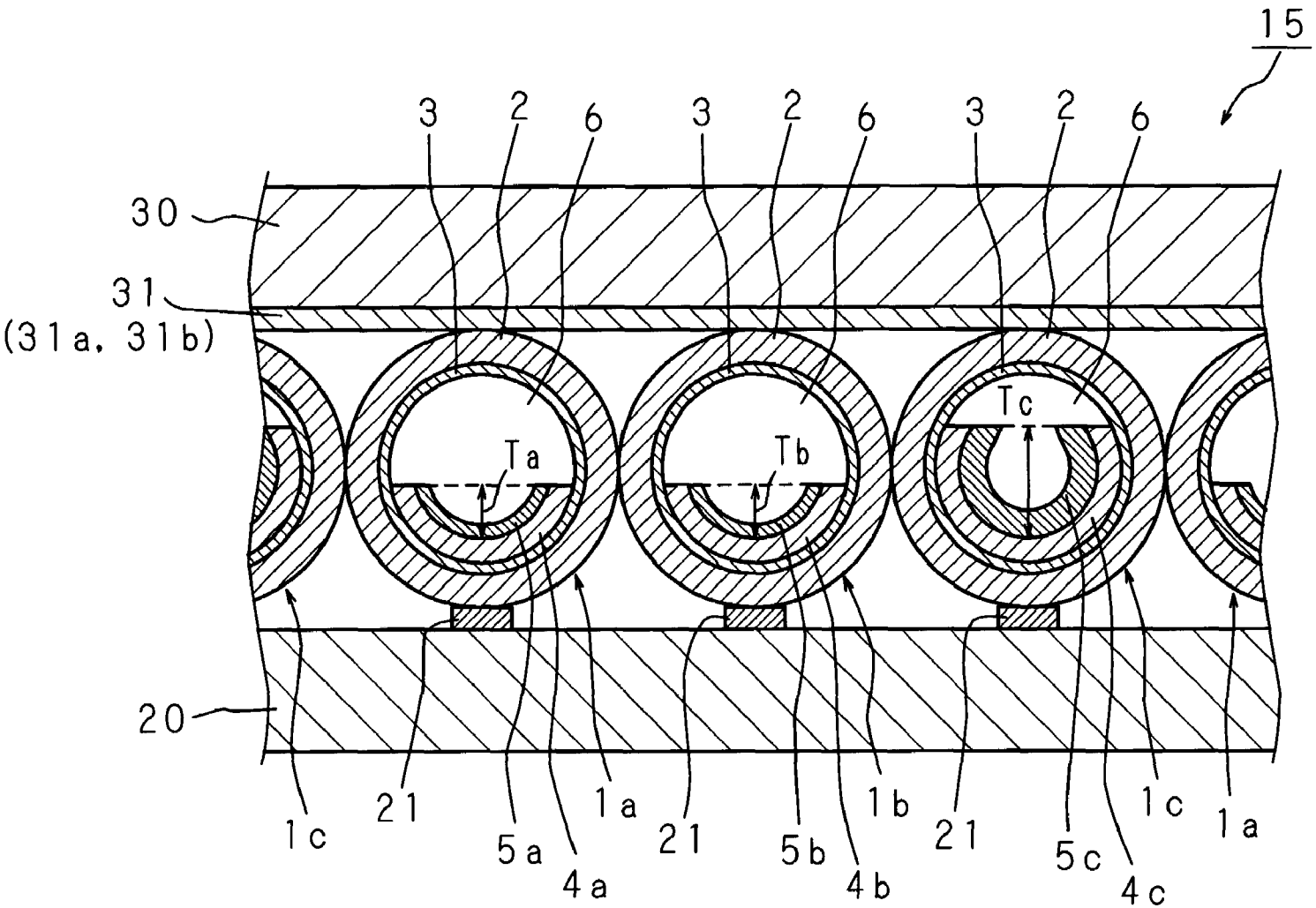
FIG. 6 is a structural cross sectional view showing one example of display device according to Embodiment 4 of the present invention.

FIG. 6 is a structural cross sectional view showing one example of display device according to Embodiment 4 of the present invention. In a display device 15 according to Embodiment 4 of the present invention, phosphor support members 4*a*, 4*b* and 4*c*, each having an axial cross section in the shape of a crescent, are disposed in the red gas discharge tube 1*a*, green gas discharge tube 1*b*, and blue gas discharge tube 1*c*, respectively. The phosphor layers 5*a*, 5*b* and 5*c*, which are to be excited by ultraviolet radiation produced by discharge to emit red, green and blue visible lights, are formed on the inner surface of the respective phosphor support members 4*a*, 4*b* and 4*c*. The maximum values of the widths of the phosphor support members 4*a*, 4*b* and 4*c*, which are the intervals in a radial direction of the respective red gas discharge tube 1*a*, green gas discharge tube 1*b* and blue gas discharge tube 1*c*, are substantially the same irrespective of the emission colors of the phosphor layers. However, based on the features of this embodiment, the relationship Ta=Tb<Tc is established, where Ta and Tb are the depths of the phosphor support members 4*a* and 4*b*, respectively, and Tc is the depth of the phosphor support member 4*c*. Note that these phosphor support members 4*a*, 4*b* and 4*c* can be easily formed by a known redraw molding method. On the other hand, the phosphor layers are formed as follows.

FIGS. 7A through 7D are schematic diagrams showing the formation of phosphor layers on phosphor layer support members having the same width and different depression depths.

Figures 7A, 7B, 7C, 7D:
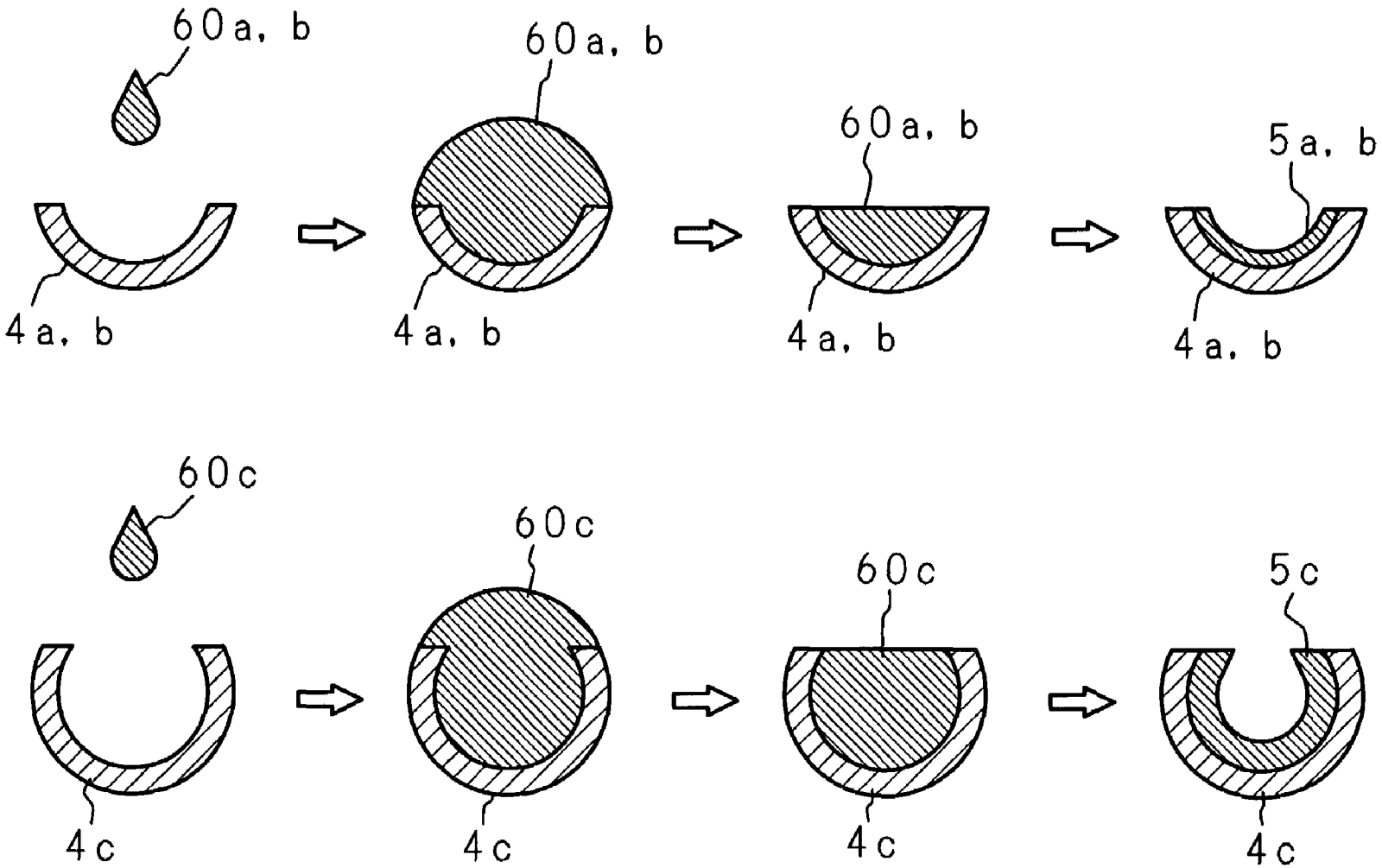
FIGS. 7A through 7D are schematic diagrams showing the formation of phosphor layers on phosphor layer support bodies having the same width and different depression depths.

First, the depressions of the phosphor support members 4*a*, 4*b* and 4*c* are filled with a red phosphor paste 60*a*, a green phosphor paste 60*b*, and a blue phosphor paste 60*c*, respectively (FIG. 7A) so that the depressions of the phosphor support members are completely covered with the respective phosphor pastes (FIG. 7B).

Next, the phosphor pastes exceeding the capacity of the depressions of the respective phosphor support members are removed by sliding a squeegee (not shown) in the longitudinal direction of the phosphor support members 4*a*, 4*b* and 4*c*. Consequently, the same amount of the phosphor pastes 60*a*, 60*b* and 60*c* as the capacity of the respective depressions remain in the depressions of the phosphor support members 4*a*, 4*b* and 4*c* (FIG. 7C). Hence, on the phosphor support members having the same width and different depths, an amount of phosphor paste according to each capacity remains.

Then, by sintering the phosphor pastes 60*a*, 60*b* and 60*c* remaining in the depressions of the phosphor support members 4*a*, 4*b* and 4*c*, the phosphor layers 5*a*, 5*b* and 5*c* are formed in the depressions of the phosphor support members 4*a*, 4*b* and 4*c*, respectively (FIG. 7D). Thus, by drying and sintering different volumes of phosphor pastes, phosphor layers with different heights from the base of the respective phosphor support members and different thicknesses can be formed on the surface of the respective phosphor support members.

Consequently, since the depths of the depressions of the respective phosphor support members satisfy the relationship Ta=Tb<Tc, the heights of phosphor layers formed on the surface of the respective phosphor support members with respect to the rear support body and the thicknesses of the phosphor layers have substantially the same relationship as the relationship in the depression depths of the phosphor support members. Accordingly, the height of the blue phosphor layer 5*c* is higher than the heights of the red and green phosphor layers 5*a* and 5*b*, and the thickness of the blue phosphor layer 5*c* is thicker than the thicknesses of the red and green phosphor layers 5*a* and 5*b*, and therefore the visible light emitted from the display device 15 is shifted toward blue, that is, the color temperature increases.

EMBODIMENT 5

Figure 8:
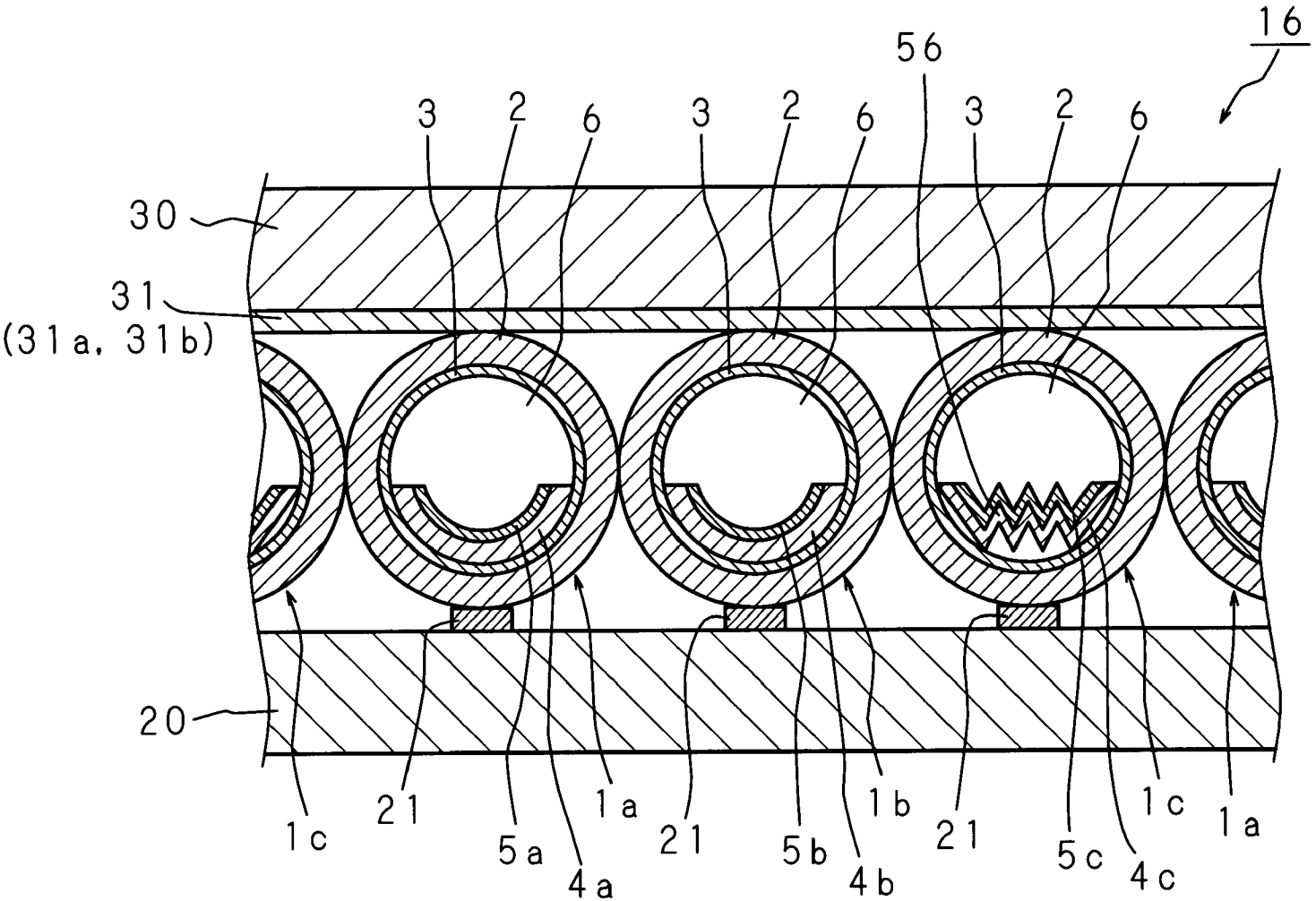
FIG. 8 is a structural cross sectional view showing one example of display device according to Embodiment 5 of the present invention.

FIG. 8 is a structural cross sectional view showing one example of display device according to Embodiment 5 of the present invention. In a display device 16 according to Embodiment 5 of the present invention, the phosphor support members 4*a* and 4*b*, each has an axial cross section in the shape of a crescent moon, are disposed inside the red gas discharge tube 1*a* and green gas discharge tube 1*b*. On the other hand, disposed inside the blue gas discharge tube 1*c* is the phosphor support member 4*c* having an axial cross section in a shape composed of a plurality of projections and depressions alternately arranged like saw teeth. On the inner surfaces of the phosphor support members 4*a*, 4*b* and 4*c*, the phosphor layers 5*a*, 5*b* and 5*c*, which are to be excited by ultraviolet radiation produced by discharge to emit red, green and blue visible lights, are formed. The widths of the phosphor support members 4*a*, 4*b* ad 4*c* are substantially the same irrespective of the emission colors of the respective phosphor layers. Since other structures are the same as those in Embodiment 1, the corresponding parts are designated with the same codes, and the detailed explanation thereof is omitted.

Thus, the phosphor layer 5*c* formed on the phosphor support member 4*c* becomes closer to the discharge surface (sustain electrode 31) due to the projections 56 of the blue phosphor support member 4*c*, and the area irradiated with ultraviolet radiation increases because of the presence of depressions and projections. Therefore, the luminescence intensity of the blue phosphor layer 5*c* relatively increases compared to the red and green phosphor layers 5*a* and 5*b*, and the visible light emitted from the display device 16 is shifted toward blue, that is, the color temperature increases. Note that the shapes of the phosphor support members 4*a*, 4*b* and 4*c* are not limited to the illustrated shapes, and it is possible to obtain a desired color temperature by suitably setting the shapes of the respective phosphor support members, based on the luminescence intensities and color characteristics of the phosphors used. A manufacturing method of a display device (method of forming a phosphor layer on a phosphor support member) according to Embodiment 5 is the same as in Embodiment 4.

EMBODIMENT 6

Figure 9:
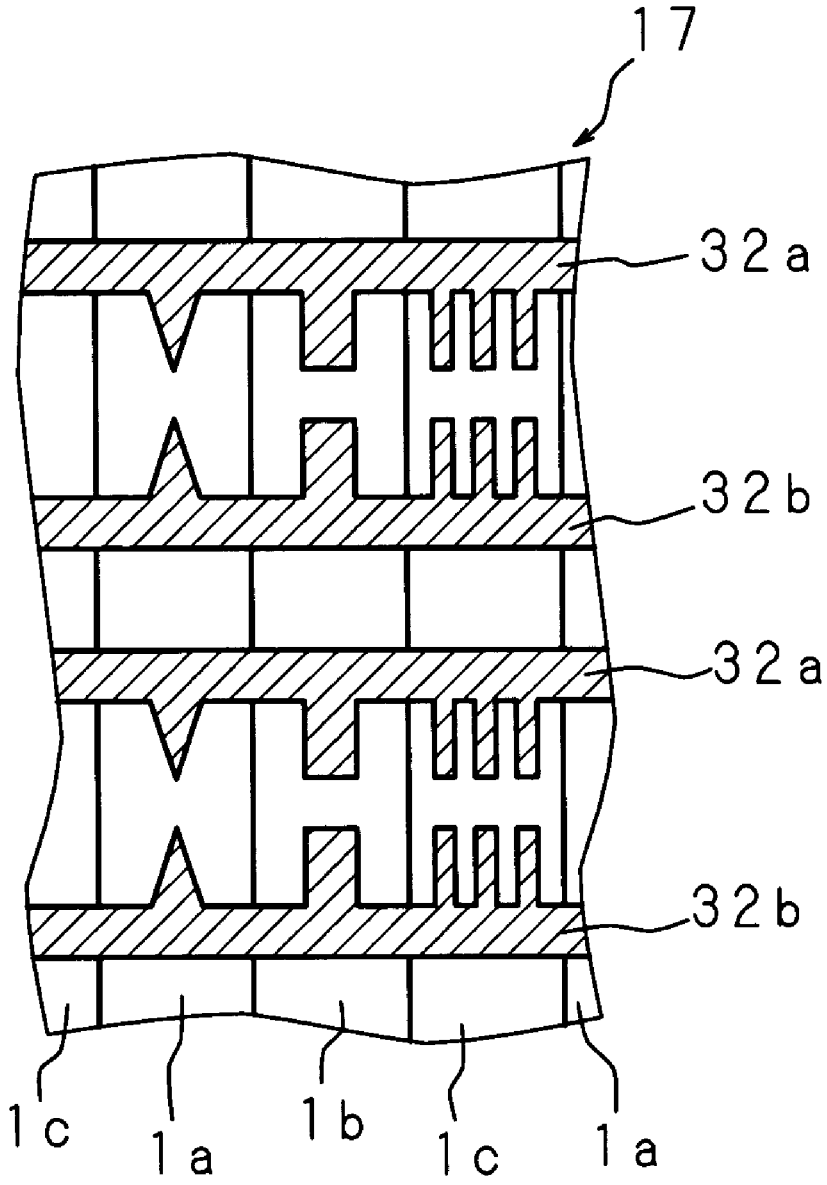
FIG. 9 is a structural cross sectional view showing one example of display device according to Embodiment 6 of the present invention.
Figure 10:
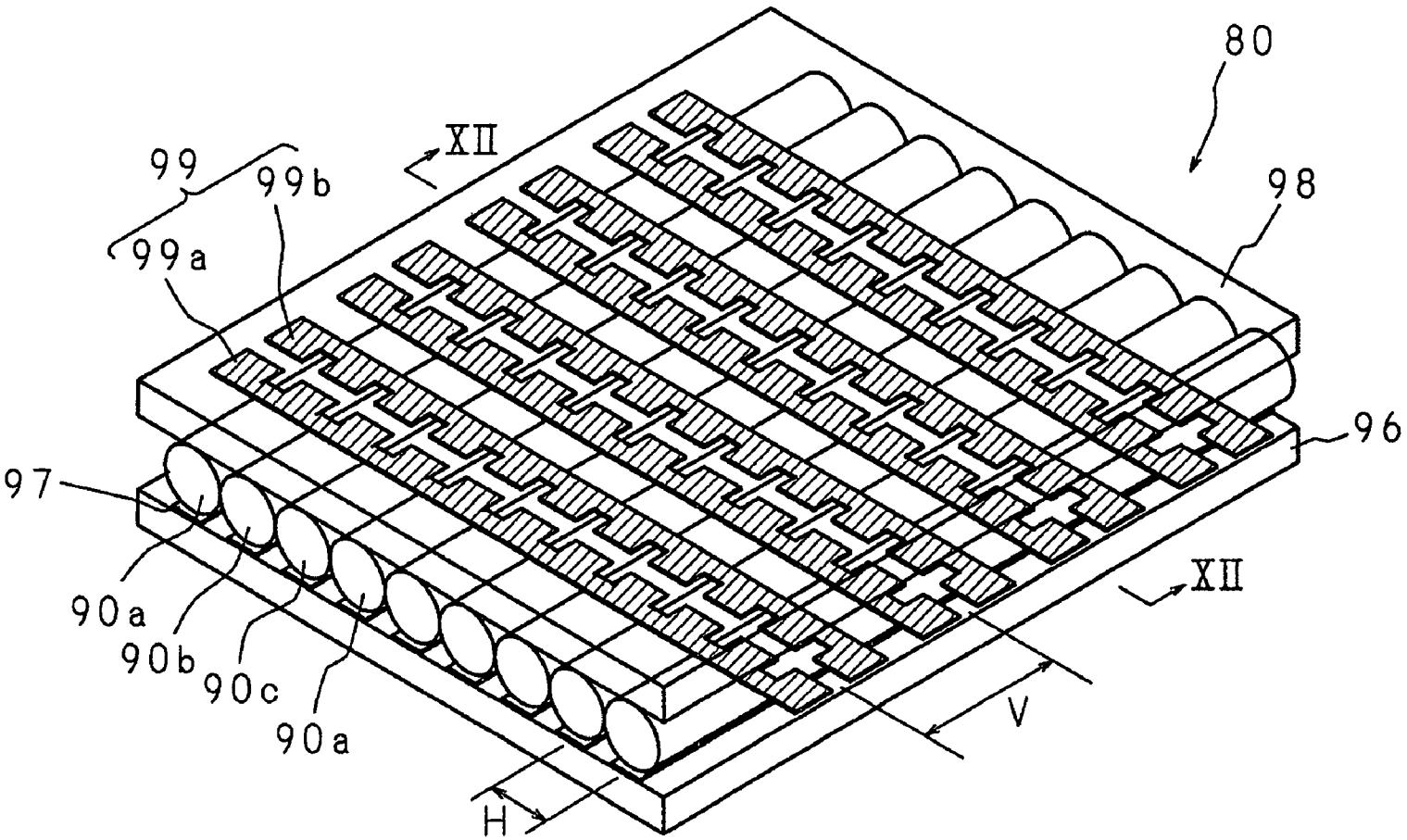
PRIOR ART FIG. 10
FIG. 10 is a schematic perspective view showing one example of conventional display device using gas discharge tubes.

FIG. 9 is a structural cross sectional view showing one example of display device according to Embodiment 6 of the present invention. A display device 17 according to Embodiment 6 of the present invention is characterized by changing the shapes of the sustain electrodes for each discharge tube, and comprises a pair of sustain electrodes 32*a* and 32*b* patterned and disposed so that triangular patterns face each other on the red gas discharge tube 1*a*, rectangular patterns face each other on the green gas discharge tube 1*b*, and a plurality of rectangular patterns face each other on the blue gas discharge tube 1*c*. Since other structures are the same as those in Embodiment 1, the corresponding parts are designated with the same codes, and the detailed explanation thereof is omitted.

In such a display device 17, even when the same voltage is applied between a pair of sustain electrodes 32*a* and 32*b*, the electric field applied between the sustain electrodes 32*a* and 32*b* varies, and thus it is possible to adjust the amount of discharge current for each emission color. For example, in this embodiment, the amount of discharge current in the blue gas discharge tube 1*c* is largest, the luminescence intensity of blue light increases greatly, and the visible light emitted from the display device 17 is shifted toward blue, that is, the color temperature increases.

Figure 11:
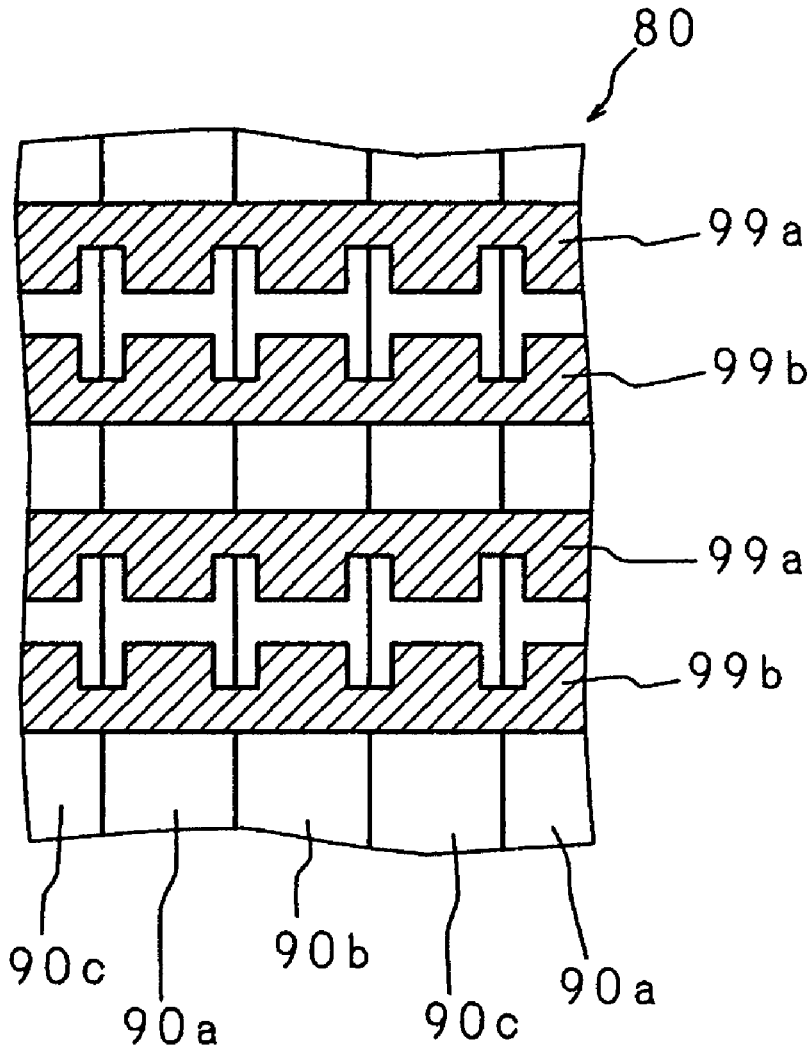
PRIOR ART FIG. 11
FIG. 11 is a plan view showing essential sections of one example of conventional display device using gas discharge tubes.
Figure 12:
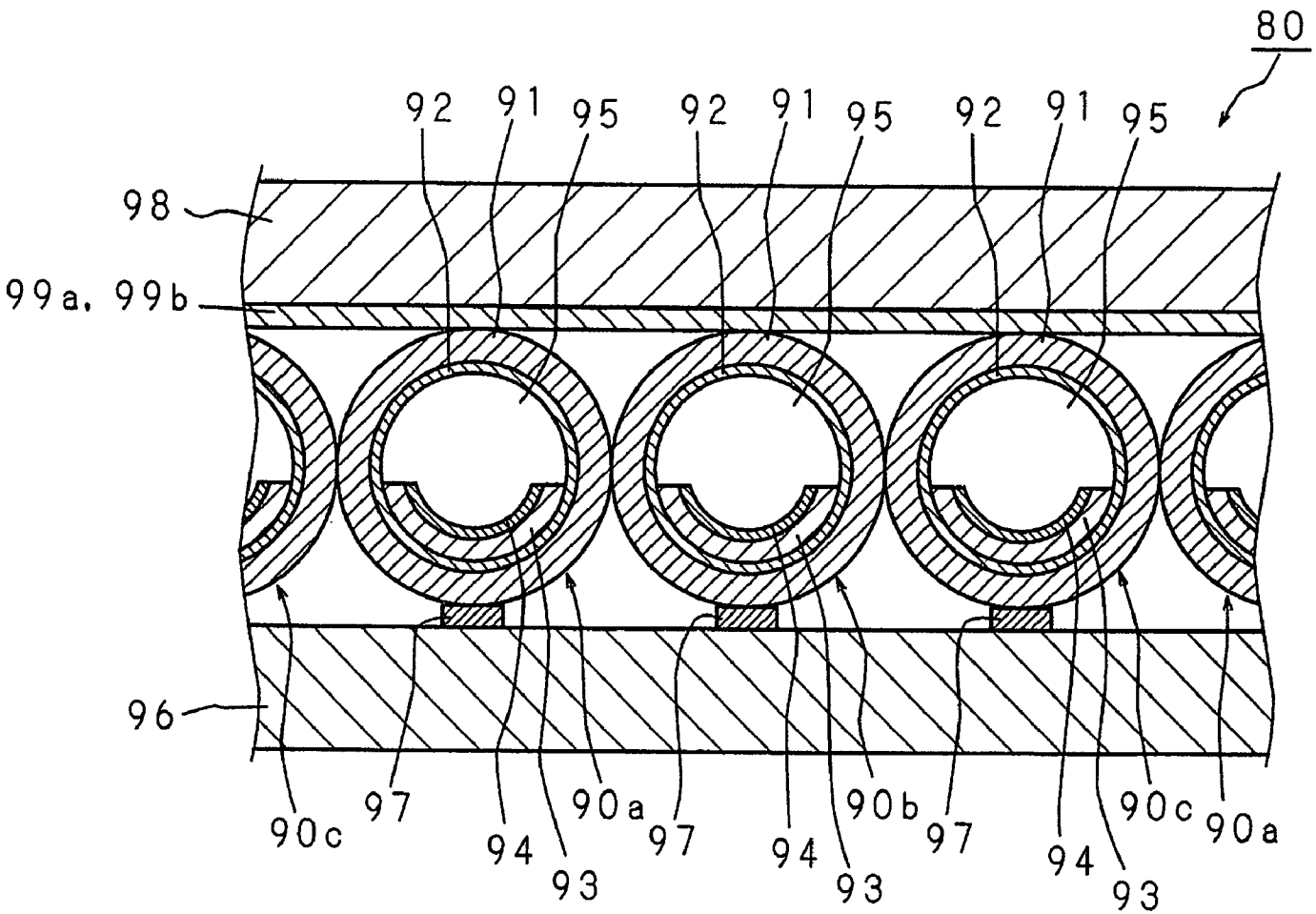
PRIOR ART FIG. 12
FIG. 12 is a structural cross sectional view along the XII-XII line of FIG. 10.

According to prior arts, since the electrodes of the same shape (see FIG. 11) are disposed on the gas discharge tubes of all emission colors and power is supplied, it is difficult to adjust the luminescence intensity by adjusting the discharge current for each emission color. On the other hand, in Embodiment 6, the discharge current can be easily adjusted by varying the shapes of the sustain electrodes on the gas discharge tubes of different emission colors. Therefore, it is possible to easily adjust the luminescence intensity for each emission color, and it is possible to realize a display device with a desired color temperature.

Note that each embodiment explains a display device using a gas discharge tube made of a glass tube in the form of a cylinder with an internal diameter of 0.8 mm and a thickness of 0.1 mm, but the gas discharge tube may be made of a glass tube with an axial cross section in a substantially rectangular or oval inner shape, for example, as long as it is a transparent insulating tubular body. Further, the outer shape of the axial cross section of the glass tube is not limited, and may have a substantially rectangular shape or a substantially oval shape. Of course, even when a glass tube with a complete round inner shape and a substantially rectangular outer shape is used, the same effects are obtained.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A display device comprising:

a plurality of gas discharge tubes having a discharge gas sealed therein, and phosphor layers corresponding to a plurality of emission colors on inner surfaces thereof;

a pair of support bodies for holding the plurality of gas discharge tubes therebetween; and a plurality of pairs of electrodes disposed on a surface of one of the support bodies and extending in a direction crossing an axial direction of the tubes, wherein the gas discharge tubes discharge through the discharge gas by applying a voltage to the pairs of electrodes, whereby the phosphor layers emit light, and wherein each of the phosphor layers is formed on a part of the inner surface of the gas discharge tube, and a ratio of a part of an area of the inner surface on which one of the phosphor layers is formed in a gas discharge tube with respect to a whole area of the inner surface varies depending on each emission color of the phosphor layer.

2. A display device comprising:

a plurality of gas discharge tubes having a discharge gas sealed therein, and phosphor layers corresponding to a plurality of emission colors on inner surfaces thereof;

a pair of support bodies for holding the plurality of gas discharge tubes therebetween; and a plurality of pairs of electrodes disposed on a surface of one of the support bodies and extending in a direction crossing an axial direction of the tubes, wherein the gas discharge tubes discharge through the discharge gas by applying a voltage to the pairs of electrodes, whereby the phosphor layers emit light, and wherein thicknesses of the phosphor layers vary depending on each emission color of the phosphor layers.

3. The display device of claim 1, wherein the gas discharge tubes have substantially the same internal diameter.

4. The display device of claim 2, wherein the gas discharge tubes have substantially the same internal diameter.

5. The display device of claim 1, wherein the phosphor layer is formed on a phosphor support member, and the phosphor support member has a different shape depending on each emission color of the phosphor layer.

6. The display device of claim 2, wherein the phosphor layer is formed on a phosphor support member, and the phosphor support member has a different shape depending on each emission color of the phosphor layer.

7. The display device of claim 3, wherein the phosphor layer is formed on a phosphor support member, and the phosphor support member has a different shape depending on each emission color of the phosphor layer.

8. The display device of claim 5, wherein the phosphor support member has a depression whose depth varies depending on each emission color of the phosphor layer.

9. The display device of claim 6, wherein the phosphor support member has a depression whose depth varies depending on each emission color of the phosphor layer.

10. The display device of claim 7, wherein the phosphor support member has a depression whose depth varies depending on each emission color of the phosphor layer.

11. The display device of claim 1, wherein shapes of the plurality of pairs of electrodes on the gas discharge tubes including the phosphor layers vary depending on each emission color of the phosphor layers.

12. The display device of claim 2, wherein shapes of the plurality of pairs of electrodes on the gas discharge tubes including the phosphor layers vary depending on each emission color of the phosphor layers.

13. The display device of claim 3, wherein shapes of the plurality of pairs of electrodes on the gas discharge tubes including the phosphor layers vary depending on each emission color of the phosphor layers.

14. The display device of claim 4, wherein shapes of the plurality of pairs of electrodes on the gas discharge tubes including the phosphor layers vary depending on each emission color of the phosphor layers.

15. The display device of claim 5, wherein shapes of the plurality of pairs of electrodes on the gas discharge tubes including the phosphor layers vary depending on each emission color of the phosphor layers.

16. The display device of claim 6, wherein shapes of the plurality of pairs of electrodes on the gas discharge tubes including the phosphor layers vary depending on each emission color of the phosphor layers.

17. The display device of claim 7, wherein shapes of the plurality of pairs of electrodes on the gas discharge tubes including the phosphor layers vary depending on each emission color of the phosphor layers.

18. The display device of claim 8, wherein shapes of the plurality of pairs of electrodes on the gas discharge tubes including the phosphor layers vary depending on each emission color of the phosphor layers.

19. The display device of claim 9, wherein shapes of the plurality of pairs of electrodes on the gas discharge tubes including the phosphor layers vary depending on each emission color of the phosphor layers.

20. The display device of claim 10, wherein shapes of the plurality of pairs of electrodes on the gas discharge tubes including the phosphor layers vary depending on each emission color of the phosphor layers.

* * * * *